US005644841A

United States Patent [19]

Stewart et al.

[11] Patent Number: 5,644,841

[45] Date of Patent: Jul. 8, 1997

[54] METHOD FOR MANUFACTURING A HEAT TRANSFER COIL

[75] Inventors: Robert T. Stewart, Grenada; Paul L. Mitchell, Duckhill, both of Miss.

[73] Assignee: Heatcraft Inc., Grenada, Miss.

[21] Appl. No.: 658,313

[22] Filed: Jun. 5, 1996

Related U.S. Application Data

[63] Continuation of Ser. No. 293,879, Aug. 19, 1994, abandoned.

[51] Int. Cl.[6] ..... B23P 15/26

[52] U.S. Cl. ..... 29/890.046; 29/890.03

[58] Field of Search ..... 29/890.046, 890.03, 29/33 G, 33 Q, 335, 726

[56] References Cited

U.S. PATENT DOCUMENTS

| | | | |
|---|---|---|---|
| 1,322,366 | 11/1919 | Spery | 39/33 G |
| 2,291,361 | 7/1942 | Walsh | 29/335 |
| 2,306,750 | 12/1942 | Rendel | 29/335 |
| 2,796,794 | 6/1957 | Bruegger | 29/33 G |
| 2,811,204 | 10/1957 | Kritzer | 29/33 G |
| 4,079,611 | 3/1978 | Osterkorn et al. | 29/890.046 |
| 4,523,364 | 6/1985 | Laws et al. | 29/33 Q |
| 5,179,770 | 1/1993 | Block et al. | 29/17.3 |
| 5,282,313 | 2/1994 | Podhorsky | 29/890.046 |

*Primary Examiner*—Irene Cuda

*Attorney, Agent, or Firm*—W. Kirk McCord

[57] ABSTRACT

A sheet of fin stock is lubricated by a roller coater having first and second lubricant-applying rollers adapted to engage respective opposed first and second sides of the sheet and to apply a first synthetic lubricant to both sides of the sheet as the sheet is pulled through the roller coater. The lubricated sheet is then formed into a plurality of coil fins by a conventional fin press. The first synthetic lubricant is devoid of petroleum ingredients and is water soluble. The first synthetic lubricant forms a hydrophilic coating on the fins. The fins are assembled with a plurality of hairpin tubes to form the coil. A second synthetic lubricant is introduced into each of the tubes prior to bending. The amount of the first synthetic lubricant applied to the fin sheet and the amount of second synthetic lubricant introduced into each hairpin tube are carefully controlled so that neither the first nor the second synthetic lubricant need be removed during the coil manufacturing process, thereby eliminating the need for a dedicated cleaning/degreasing operation. The first synthetic lubricant has a relatively low volatility so that a special emissions permit is not required and has relatively low BOD, FOG and COD levels so that a special water permit is not required.

20 Claims, 4 Drawing Sheets

METHOD FOR MANUFACTURING A HEAT TRANSFER COIL

This is a continuation of application Ser. No. 08/293,879 filed on Aug. 19, 1994, now abandoned.

TECHNICAL FIELD

This invention relates generally to heat transfer coils of the type used in air conditioning and refrigeration systems and in particular to an improved apparatus and method for manufacturing heat transfer coils.

BACKGROUND ART

A heat transfer coil of the type used in air conditioning and refrigeration systems typically includes a plurality of refrigerant-carrying tubes and a plurality of fins extending between the tubes to enhance the heat transfer between the refrigerant in the tubes and the air passing through the coil. The tubes are typically made of aluminum, copper or stainless steel material. The fins are typically made of thin sheets of aluminum, copper, stainless steel or carbon steel material.

Coil manufacturing usually involves one of the following two processes: (1) application of petroleum-based lubricant to the fin stock prior to the fin stamping operation and to the tubes prior to both the bending and expanding operations, followed by application of a solvent-based vapor degreaser or an aqueous-based cleaning solution to remove lubricant residue; or (2) application of an evaporative lubricant containing approximately 90% mineral spirits and 10% petroleum additives to the fin stock before the fin stamping operation and applying a petroleum-based lubricant to the tubes prior to the tube bending operation.

The aforementioned first process, using a petroleum-based fin lubricant, involves the following steps: (a) continuous coil stock fin material (e.g., aluminum, copper, stainless steel or carbon steel raw material of 0.0045 to 0.0160 inch thickness) is fed into a fin press from an unreeler; (b) the fin material is passed through an oil bath filled with a petroleum-based lubricant and then through a pair of variable pressure rollers, which remove excess lubricant from the fin material; (c) the fin material is then worked through a fin press and die to form the desired fin configuration and fin density; (d) the tube material (e.g., copper, aluminum or stainless steel material) is fed in straight lengths into a tube bender where a petroleum-based lubricant is applied inside each tube length and each tube length is bent to form a U-shaped hairpin; (e) the hairpins are laced through openings in the fin collars to form a fin pack; (f) a petroleum-based lubricant is applied inside each hairpin and the hairpins are expanded by an expander tip to the desired diameter (e.g., 0.004 to 0.008 inch larger than the diameter prior to expansion), thereby "locking" the hairpins into the fin pack to form the coil; (g) the coil is then routed through a centralized, solvent-based vapor degreaser or, alternatively, through an aqueous-based cleaning system to clean both the fins and hairpins internally as well as externally; (h) return tube bends, distributors and headers are brazed to the coil in order to complete the coil assembly; (i) the assembled coil is leak tested, dried with blown air and routed through a dehydration oven; (j) the coil may be painted; and (k) the coil is purged internally with dry air to remove moisture and after the open tubes are sealed, the coil is boxed and ready for shipping.

The above-described first process, using a petroleum-based fin lubricant, has several disadvantages. One disadvantage is that some of the solvents used to remove the petroleum-based lubricant are designated by the Environmental Protection Agency (EPA) as suspected ozone depleaters. As such, certain control safeguards must be implemented and continually maintained in order to safely control vapors emitted from the solvent. Further, the solvents have a low flash point and are expensive to use because of the increased air quality regulations. Another disadvantage is that some petroleum-based lubricants applied to the fin stock are suspected as being carcinogenic with prolonged exposure to the skin and its discharge into water systems is strictly regulated. The use of aqueous-based cleaning systems instead of a solvent-based degreaser requires on-site filtration and waste water treatment, special disposal of filters and solids, and expensive modification of systems using solvent-based vapor degreasers. Due to the expense of implementing a cleaning system to remove lubricant residue from the fins and coils, it is not practical to operate a solvent-based vapor degreaser for each fin press line. As such, all assembled coils must be cleaned using a centralized cleaning system, which creates a bottleneck in the manufacturing process.

The aforementioned second process, using an evaporative fin lubricant, is normally used in facilities with a relatively small number (ten or fewer) of fin presses. This second process includes the following steps: (a) continuous coil stock fin material is fed from an unreeler through an oil bath filled with an evaporative lubricant and then through a pair of variable pressure rollers to remove excess lubricant; (b) evaporative lubricant is also applied through specially-designed die sections of the fin press for a period of about five seconds prior to operating the fin press and also during fin press operation; (c) the fin material is worked through the fin press and dies to form the fins with the desired fin configuration and fin density; (d) a petroleum-based lubricant is applied inside each straight length of tube at the location where each tube length is to be bent and the tube lengths are bent to form respective hairpins, as previously described; (e) the hairpins are laced through openings in the fin collars to form a fin pack; (f) the hairpins are expanded to the desired diameter with expander tips to form the coil (a petroleum-based lubricant is not applied to the hairpins during the expanding operation); (g) the assembled coils are stacked and staged for brazing, during which time the evaporative lubricant substantially evaporates, but the 10% petroleum-based additive remains on the fins; (h) return bends, distributors and headers are brazed to the coil to complete the coil assembly; (i) the assembled coil is leak tested, air blown, dehydrated, painted and dry air purged, and the open tubes are sealed, followed by boxing and shipping of the assembled coil.

This second process, using an evaporative lubricant, has several disadvantages. One disadvantage is that the volatile organic compound (VOC) emissions from the evaporative lubricant require a special permit from the EPA. Because of the permit requirement, the use of evaporative lubricants is not practical when there are a large number (i.e., more than ten) fin presses in a facility. Other disadvantages are that evaporative lubricants emit noxious vapors in operator breathing zones; the evaporative lubricants are petroleum-based and therefore subject to stringent disposal regulations; the use of evaporative lubricants results in diminished tooling life compared to non-evaporative lubricants because evaporative lubricants are comprised of approximately 10% petroleum, diluted with approximately 90% mineral spirits. The relatively poor tooling performance results in increased fin and die maintenance with related expenses and production downtime. Further, the fin press dies and controls must be specially designed to allow application of the evaporative lubricant through the dies, requiring fin press dwell prior to operation of the press, and the quality of fins produced with evaporative lubricants is typically inferior, which makes it more difficult to lace the hairpins through the fins during coil assembly. Also, a slight oil residue is left on the fins behind the coil header plate after the brazing operation. The major advantage of using evaporative lubricants is that a separate cleaning/degreasing step is not required.

A synthetic, non-petroleum-based fin lubricant has been used in lieu of petroleum-based lubricants in a coil manufacturing process. Various techniques may be used for applying the synthetic lubricant. One such technique is the conventional bath, whereby the fin material is immersed in the synthetic lubricant prior to entering the fin press. Although the conventional bath system is relatively inexpensive, an excessive amount of the synthetic lubricant is applied to the fin material. Although the variable pressure rollers are effective in removing some of the excess lubricant, the residue is still beyond acceptable limits. Further, the amount of lubricant applied to the fin material is a function of the viscosity of the lubricant. The greater the viscosity, the greater is the amount of lubricant applied to the fin material. To alleviate this problem, a recirculating heating system may be used to reduce the viscosity of the lubricant and therefore decrease the amount applied to the fin material. However, even with a recirculating heating system, the lubricant residue exceeds acceptable limits in the leak test tank and dehydration oven.

Another technique used to apply a synthetic lubricant to the fin material in a coil manufacturing process is an air-type spray system using a plurality of nozzles to atomize the synthetic lubricant applied to the fin material. Although the air-type spray system is effective in reducing the quantity of lubricant applied to the fin material, the system generates a large quantity of lubricant mist in the operators' breathing zones. To protect the operators, a vacuum system with an enclosure around the nozzles is required in order to contain the mist. This vacuum system takes up valuable floor space and requires regular maintenance, in addition to the initial expense.

Yet another technique for applying a synthetic lubricant to the fin material in a coil manufacturing process is an airless spray system, which has the advantage of reducing the quantity of lubricant mist in the operators' breathing zones. As such, a vacuum system is not required to contain the mist. Airless spray systems utilize air-assisted pistons which supply a metered volume of lubricant by hydraulic pressure to a nozzle, which atomizes the lubricant into a spray pattern. Among the disadvantages of the airless spray system are that each nozzle requires a dedicated hydraulic pump, which increases the likelihood of system failures and other related problems, particularly with the relatively large number of pumps and nozzles required for each fin press. If one of the nozzles fails to operate properly, part of the fin material may not receive the proper amount of lubricant, which can result in damage to the fin press and production downtime.

There is, therefore, a need for an improved process of manufacturing heat transfer coils, which does not require a separate cleaning step to remove lubricant residue from the tubes and fins of the coil and which is characterized by sufficiently low VOC emissions that special EPA permits are not required. There is also a need for an improved method of applying a synthetic, non-petroleum-based lubricant to the fin material in a coil manufacturing process.

DISCLOSURE OF INVENTION

In accordance with the present invention, apparatus is provided for manufacturing fins of a heat transfer coil. The apparatus is comprised of fin stock supply means for supplying a sheet of fin stock; lubricating means adapted to receive the sheet from the supply means for applying a predetermined amount of first lubricant to respective opposed first and second sides of the sheet using first and second lubricant-applying rollers engageable with the respective first and second sides; press means adapted to receive the sheet from the lubricating means and to form the sheet into at least one coil fin; feeding means for feeding the sheet through the press means; and control means for coordinately controlling operation of the supply means, lubricating means and press means to control movement of the sheet.

In accordance with one embodiment of the invention, the supply means includes a rotatable reel having the fin stock wound in a continuous sheet thereon and unwinding means for rotating the reel to unwind the sheet therefrom. The control means is adapted to control movement of the sheet such that the sheet defines a first slack loop between the reel and the lubricating means and a second slack loop between the lubricating means and the press means.

In accordance with one aspect of the invention, the control means includes first, second, third and fourth detecting means. The first and second detecting means are located to define respective upper and lower limits of the first slack loop corresponding to respective minimum and maximum slack conditions of the first slack loop. The third and fourth detecting means are located to define respective upper and lower limits of the second slack loop corresponding to respective minimum and maximum slack conditions of the second slack loop. The control means is operable to disable the feeding means and the first and second rollers from pulling the sheet through the press means and the lubricating means, respectively, in response to the first slack loop being detected at its upper limit by the first detecting means and to disable the unwinding means from unwinding the sheet from the reel in response to the first slack loop being detected at its lower limit by the second detecting means. The control means is further operative to disable the feeding means and the first and second rollers from pulling the sheet through the press means and the lubricating means, respectively, in response to the second slack loop being detected at its upper limit by the third detecting means and to disable the first and second rollers from pulling the sheet through the lubricating means in response to the second slack loop being detected at its lower limit by the fourth detecting means. The first, second, third and fourth detecting means are preferably first, second, third and fourth electrical limit switches, respectively.

In accordance with another aspect of the invention, the lubricating means further includes third and fourth rollers in cooperative relationship with the respective first and second rollers for controlling the amount of the first lubricant applied to the sheet. The third and fourth rollers are engageable in variable pressure engagement with the respective first and second rollers to meter the amount of the first lubricant applied to the respective first and second rollers, whereby the first and second rollers are controlled to apply the predetermined amount of the first lubricant to the sheet.

In accordance with yet another aspect of the invention, the first lubricant is a synthetic lubricant devoid of petroleum ingredients and is substantially water soluble. Further, the residue of the first lubricant forms a hydrophilic coating on the fins and is relatively non-volatile.

In operation, a sheet of continuous fin stock is fed to the lubricating means. The lubricating means is operated such that the first and second rollers pull the sheet through the lubricating means and apply the predetermined amount of the first lubricant to both sides of the sheet. After the sheet has been lubricated, it is fed into the press means where the sheet is formed into at least one coil fin. The movement of the sheet between the supply reel and the lubricating means and between the lubricating means and the press means is controlled by coordinately controlling operation of the fin stock supply means, lubricating means and press means.

After the fin has been formed, it is preferably assembled with a plurality of such fins and at least one tube to form a coil slab. Prior to each tube being assembled with the fins, it is bent at a selected location. Before the tube is bent, a second lubricant, which may be a petroleum lubricant but is preferably a synthetic refrigerant oil, is introduced into each tube at the location where the tube is to be bent. The bent tubes are then laced through the fins to form the coil slab. The tubes are then expanded without adding more of the second lubricant to the tubes and the coil assembly is completed by brazing the coil slab at selected locations to form at least one tube circuit adapted to receive refrigerant. Neither the first nor the second lubricant need be removed during the brazing operation, thereby eliminating the need for a dedicated fin cleaning step in the manufacturing process. The residue of the first lubricant on the fins is paint-receptive.

Using a synthetic, non-petroleum based fin lubricant and controlling the amount of lubricant applied to the fin stock sheet eliminates the need for a dedicated cleaning/degreasing step, thereby reducing the cost and time associated with the coil manufacturing process. The amount of the second lubricant applied to the interior of each tube is also controlled so that the second lubricant need not be removed from the tubes. As such, the second lubricant is applied to the interior of the tubes only during the bending operation and not during the expanding operation.

BEST MODE FOR CARRYING OUT THE INVENTION

The best mode for carrying out the invention is described hereinbelow with reference to the accompanying drawings. Like parts are marked throughout the specification and drawings with the same respective reference numbers. The drawings are not necessarily to scale and in some instances proportions may have been exaggerated in order to more dearly depict certain features of the invention.

Figure 1:
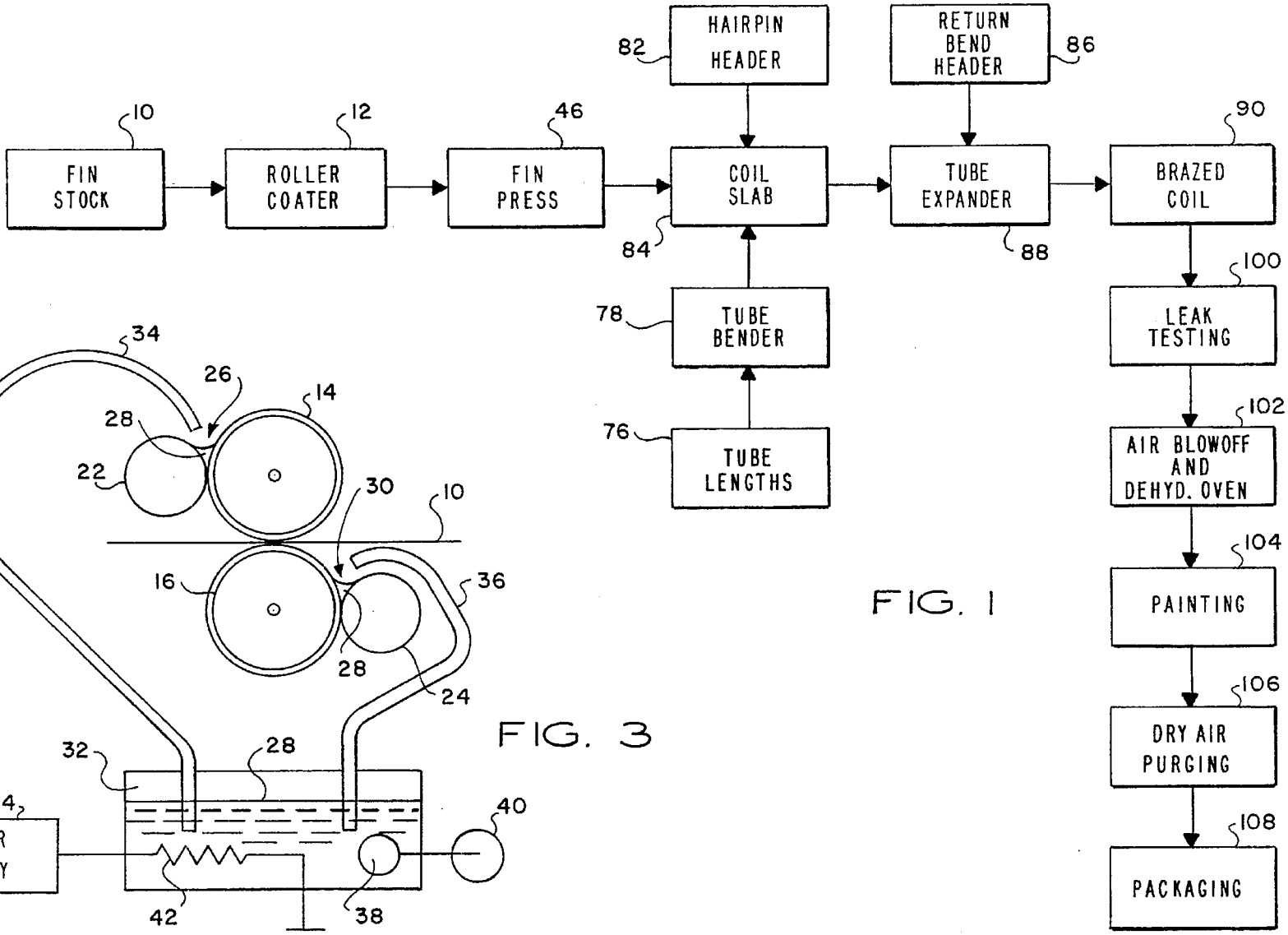
FIG. 1 is a schematic block diagram of an apparatus and method for manufacturing a heat transfer coil, according to the present invention.
Figure 3:
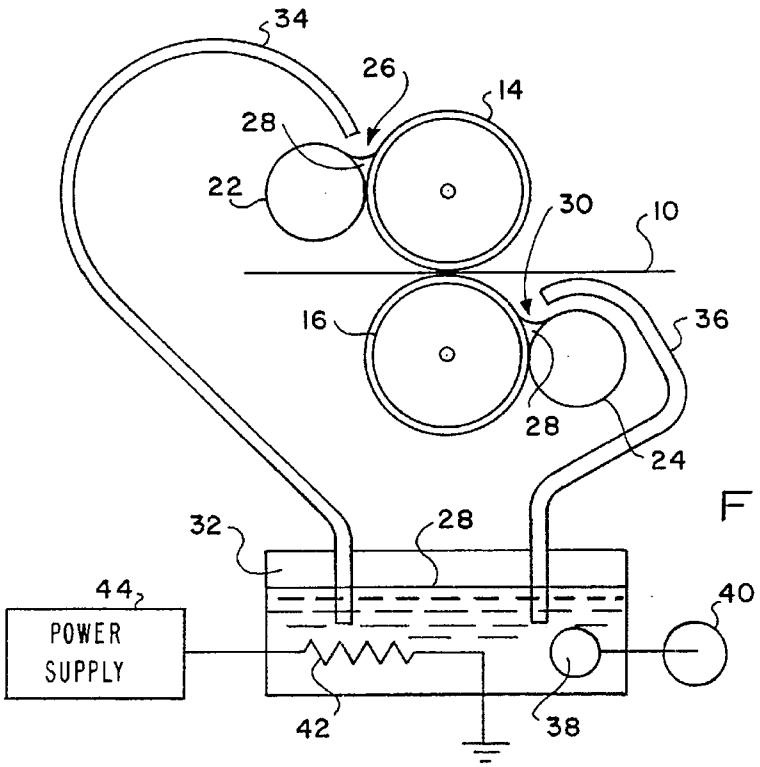
FIG. 3 is a detailed view, illustrating the lubrication of fin stock material, according to the present invention.
Figure 2:
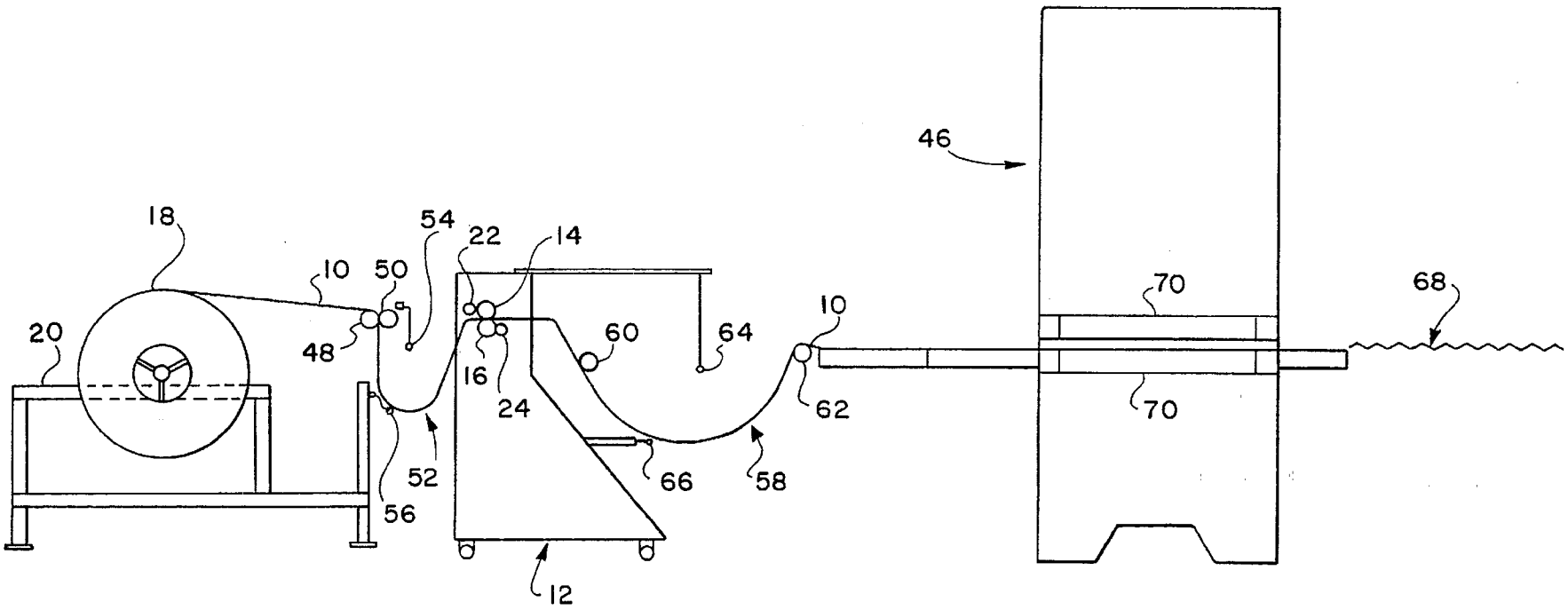
FIG. 2 is a side elevation view of a portion of the apparatus, illustrating the manufacture of fins of the heat transfer coil, according to the present invention.

Referring to FIGS. 1–3, a sheet 10 of fin stock (preferably aluminum, carbon, stainless steel or carbon steel raw material) having a thickness of approximately 0.0045 to 0.0160 inch is supplied to a roller coater 12, where a predetermined amount of lubricant (i.e., 0.1 to 1.0 grams per square foot, depending on the height of the collars to be formed on the fins) is applied to both sides of sheet 10 by a pair of lubricant-applying rollers 14 and 16. Sheet 10 is wound on a storage reel 18, which is supported on a frame 20. Rotation of reel 18 unwinds fin stock 10 in a continuous sheet.

Referring specifically to FIGS. 2 and 3, roller coater 12 is preferably a roller coater of the Series 15, Model A type, sold by Union Tool Corp. of Warsaw, Ind. Roller coater 12 has first and second doctor rollers 22 and 24 in cooperative relationship with respective first and second lubricant-applying rollers 14 and 16. Rollers 14, 16, 22 and 24 are substantially cylindrical. Rollers 22 and 24 have a substantially smaller diameter (e.g., approximately 4⅜ inches) than the diameter of rollers 14 and 16 (e.g., approximately 6½ inches) and are made of chrome-plated steel. Rollers 14 and 16 are rubber coated.

As can be best seen in FIG. 3, roller 22 is in contact with roller 14 to define a first trough 26 for receiving a first synthetic lubricant 28. Similarly, roller 24 is in contact with roller 16 to define a second trough 30 for receiving lubricant 28. Lubricant 28 is stored in a sump 32. First and second lubricant supply lines 34 and 36 supply lubricant 28 to first and second troughs 26 and 30, respectively. A pump 38 immersed in lubricant 28 within sump 32 pumps lubricant 28 through supply lines 34 and 36. Pump 38 is driven by a motor 40 external to sump 32. An electrically resistive heating element 42 is immersed in lubricant 28 within sump 32 for heating lubricant 28 to a predetermined temperature (e.g., 150°–160° F.). By the time lubricant 28 reaches troughs 26 and 30, the temperature will have dropped to approximately 120° F. Heating element 42 receives electrical power from an AC power supply 44. The temperature of lubricant 28 is a significant factor in controlling the amount of lubricant 28 applied to sheet 10.

Rollers 22 and 24 are in variable pressure engagement with respective rollers 14 and 16 and are adjustable to adjust the pressure applied to rollers 14 and 16. The greater the pressure exerted by rollers 22 and 24 against respective rollers 14 and 16, the less will be the amount of lubricant 28 applied to sheet 10. Therefore, rollers 22 and 24 meter the amount of lubricant 28 applied to rollers 14 and 16, which in turn controls the amount of lubricant 28 applied to sheet 10.

In operation, rollers 14 and 16 are driven together by a variable speed motor (not shown). Roller 14 is rotated counterclockwise (as viewed in FIGS. 2 and 3) by the variable speed motor and roller 16 is rotated clockwise. Rollers 14 and 16 are in pressure engagement with each other, with sufficient pressure therebetween to pull sheet 10 through roller coater 12 without slippage. Roller 22 is driven by roller 14 in a clockwise direction (as viewed in FIGS. 2 and 3) and roller 24 is driven by roller 16 in a counterclockwise direction. Roller 14 applies a predetermined amount of lubricant 28 to the top side of sheet 10 and roller 16 applies a predetermined amount of lubricant 28 to the bottom side of sheet 10. After sheet 10 has been lubricated by roller coater 12, it is fed to a fin press 46, which forms sheet 10 into individual fins, as will be described in greater detail hereinafter.

Referring again to FIGS. 1 and 2, fin press 46 feeds sheet 10 therethrough with a stroke-and-dwell, pull-type feed. Therefore, roller coater 12 and fin press 46 must be coordinately controlled to control the movement of sheet 10. First and second pinch rollers 48 and 50 are located intermediate reel 18 and roller coater 12. Sheet 10 defines a first slack loop 52 between the position of rollers 48 and 50 and roller coater 12. As can be best seen in FIG. 2, sheet 10 is constrained to pass between rollers 48 and 50, which are in pressure engagement. Roller 48 is motor-driven and drivers roller 50, which is an idler roller. Rotation of roller 48 in a clockwise direction (as viewed in FIG. 2) rotates roller 50 counterclockwise. The pressure engagement between rollers 48 and 50 unwinds sheet 10 from reel 18. First and second electrical limit switches 54 and 56 are located to define respective upper and lower limits of first slack loop 52 corresponding to respective minimum and maximum slack conditions of loop 52 and cooperate to maintain first slack loop 52 within its upper and lower limits. If loop 52 contacts upper limit switch 54, a minimum slack condition is indicated and rollers 14 and 16 and press 46 are disabled to arrest the movement of sheet 10 through roller coater 12 and press 46. If loop 52 contacts lower limit switch 56, a maximum slack condition is indicated and rollers 48 and 50 are disabled to arrest the unwinding of sheet 10 from reel 18.

Sheet 10 defines a second slack loop 58 between roller coater 12 and fin press 46. Idler rollers 60 and 62 are positioned to help maintain second slack loop 58. Third and fourth electrical limit switches 64 and 66 are located to define respective upper and lower limits of second slack loop 58 corresponding to respective minimum and maximum slack conditions of loop 58 and cooperate to maintain loop 58 within its upper and lower limits. If loop 58 contacts upper limit switch 64, a minimum slack condition is indicated and rollers 14 and 16 and fin press 46 are disabled to arrest the movement of sheet 10 through roller coater 12 and press 46. If loop 58 contacts lower limit switch 66, a maximum slack condition is indicated and rollers 14 and 16 are disabled to arrest the movement of sheet 10 through roller coater 12. The movement of sheet 10 through roller coater 12 and fin press 46 is therefore controlled by maintaining first and second slack loops 52 and 58 within the respective limits defined by limit switches 54, 56, 64 and 66.

At the commencement of operation, loops 52 and 58 are typically in their maximum slack positions (i.e., in contact with respective limit switches 56, 66, as shown in FIG. 2). Press 46 is started, which draws sheet 10 into press 46 and reduces the slack of loop 58 so that loop 58 is no longer in contact with limit switch 66. In response to loop 58 not being in contact with limit switch 66, roller coater 12 is started to begin pulling sheet 10 therethrough. Further, start-up of roller coater 12 reduces the slack of loop 52 so that loop 52 is no longer in contact with limit switch 56. In response to loop 52 not being in contact with limit switch 56, rollers 48, 50 are enabled to pull sheet 10 from reel 18. Press 46, roller coater 12 and rollers 48, 50 are coordinately controlled to maintain loops 52 and 58 within their respective upper and lower limits. Rollers 14, 16, 48, 50 are automatically enabled and disabled in response to corresponding indications from lower limit switches 56, 66. However, if either of the upper limit switches 54, 64 is contacted during operation, press 46 and roller coater 12 are disabled and must be manually re-started by an operator.

Maintaining the temperature of lubricant 28 within a predetermined range and controlling the pressure applied by doctor rollers 22 and 24 to lubricant-applying rollers 14 and 16 allows the amount of lubricant 28 applied to sheet 10 to be controlled within relatively precise limits. For example, operation of roller coater 12 has typically resulted in approximately 0.403 grams of lubricant per square foot of sheet as compared to approximately 0.465 grams per square foot when lubricant is applied using an airless spray system and 0.931 grams per square foot when lubricant is applied with a conventional oil bath. As such, the amount of lubricant 28 applied to sheet 10 can be more precisely controlled using roller coater 12, as described hereinabove, as compared with prior art lubricating systems. Another advantage of roller coater 12 as compared to prior art lubricating systems is that rollers 14 and 16 drive sheet 10 through roller coater 12 rather than sliding the sheet through a pair of squeegee rollers to remove excess lubricant, as in the conventional oil bath system. Using the lubricant-applying rollers 14 and 16 to drive sheet 10 reduces the likelihood of sheet 10 becoming jammed, which results in production down time and possible tooling damage.

Lubricant 28 is a synthetic lubricant devoid of petroleum ingredients and is substantially water soluble. Further, lubricant 28 forms a hydrophilic coating on the coil fins. Lubricant 28 should be compatible with various fin-forming operations, including drawing fin stock material to form a fin pack having a density in the range of 4–24 fins per inch, and should not result in excessive or abnormal tooling wear as compared to that experienced with conventional petroleum lubricants. Lubricant 28 also has a relatively low volatility (less than 10% by weight of lubricant 28 applied to the fin sheet is evaporated), thereby resulting in relatively low VOC emissions so that an emissions permit is not required to use synthetic lubricant 28, and relatively low BOD, FOG and COD levels so that no special water permits are required. A synthetic lubricant having the designation HCG-37 and sold under the trademark "Lenlube" by Morris-Thorne Technologies Corporation of Tampa, Fla. is a suitable lubricant for use in the fin and coil forming process. The hydrophilic coating formed on the fins by the residue of lubricant 28 tends to absorb moisture. Therefore, a rust inhibitor should be added to lubricant 28.

Figure 4:
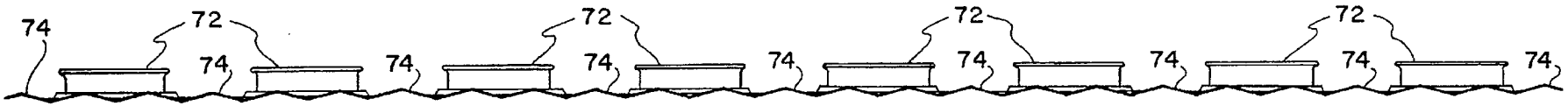
FIG. 4 is a detailed view of a fin manufactured by the apparatus of FIGS. 1 and 2.
Figure 5:
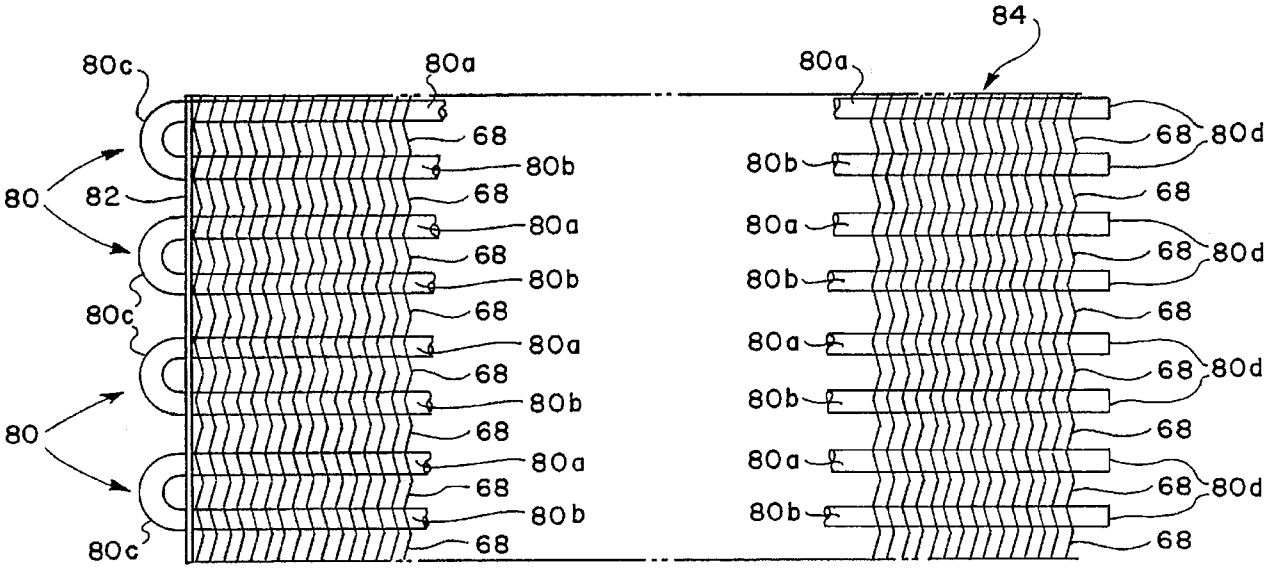
FIG. 5 is an elevation view of a coil slab with one header plate, assembled according to the present invention.
Figure 6:
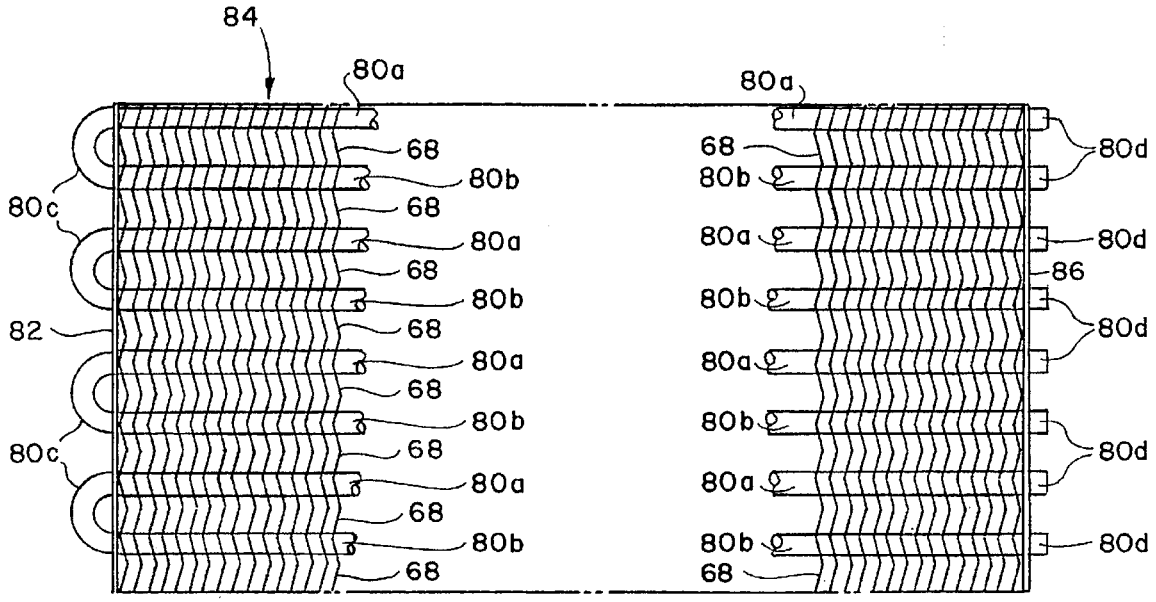
FIG. 6 is an elevation view of the coil slab with two header plates after the coil tubes have been expanded.

Referring to FIGS. 2, 4 and 5, fin press 46 includes a plurality of dies 70 to form sheet 10 into a plurality of coil fins 68. Each fin 68 has a plurality of fin collars 72 and corrugations 74, as can be best seen in FIG. 4. Collars 72 each have an opening extending therethrough. Referring also to FIGS. 1 and 5, a plurality of tube lengths 76 made of copper, aluminum or stainless steel material are bent by a tube bender 78 to form a respective plurality of U-shaped hairpins 80. A predetermined amount of a second lubricant (no more than 0.110 cubic centimeters per hairpin and preferably between 0.050 and 0.095 cubic centimeters) is introduced into each tube length 76 at the approximate location where the corresponding tube length 76 is to be bent. The second lubricant is preferably a synthetic refrigerant oil of the SW32 type sold by Castrol of Irvine, Calif. The amount of the second lubricant introduced into each tube length should be carefully controlled because the second lubricant will not be removed from the tube during the coil manufacturing process. As such, the second lubricant must be compatible with refrigerants subsequently used in the coil. To precisely control the amount of the second lubricant introduced into each tube length 76, an automatic metering valve (not shown) is included in tube bender 78 for introducing a metered quantity of the second lubricant into each tube length 76 through a mandrel of tube bender 78. The metering valve is preferably an automatic metering valve of the 482-C AMV type sold by Sealed Power Corporation of Wixom, Mich. Furthermore, because the interior of each tube is not cleaned during the coil manufacturing process, solid residue (e.g., copper strips, brazing residue and other solids) in each tube must be limited to no more than approximately 0.018 grams per square foot of internal surface area of the corresponding tube. Referring to FIGS. 1 and 5, hairpins 80 are laced through aligned openings in the fin collars 72 of a plurality of fins 68. A hairpin header 82 also has a plurality of openings aligned with the fin openings for receiving straight legs 80*a* and 80*b* of each hairpin 80. Hairpin header 82 is proximate to the U-shaped end portion 80*c* of each hairpin 80. The assembly of hairpins 80 with fins 68 and hairpin header 82 forms a coil slab 84.

A return bend header 86 having a plurality of openings alignable with the fin openings is laced onto distal ends 80d of each hairpin 80 such that return bend header 86 is in opposed relationship with hairpin header 82. A tube expander 88 expands the diameter of each hairpin 80 by approximately 0.004 to 0.008 inch larger than its pre-expanded diameter, thereby locking hairpins 80 into fins 68. No additional lubricant is added to hairpins 80 during the expansion operation because of the 0.110 cubic centimeters of lubricant per hairpin limitation. Without additional lubricant during the expansion operation, hairpin shrinkage will be greater than if additional lubricant were applied. Therefore, hairpins 80 must be made slightly longer than the hairpins used in prior art processes where additional lubricant is applied prior to expansion. Further, excessive shrinkage of hairpins 80 during expansion without additional lubricant may require the tips of tube expander 88 to be reduced in diameter by approximately 0.001 to 0.002 inch.

Figure 7:
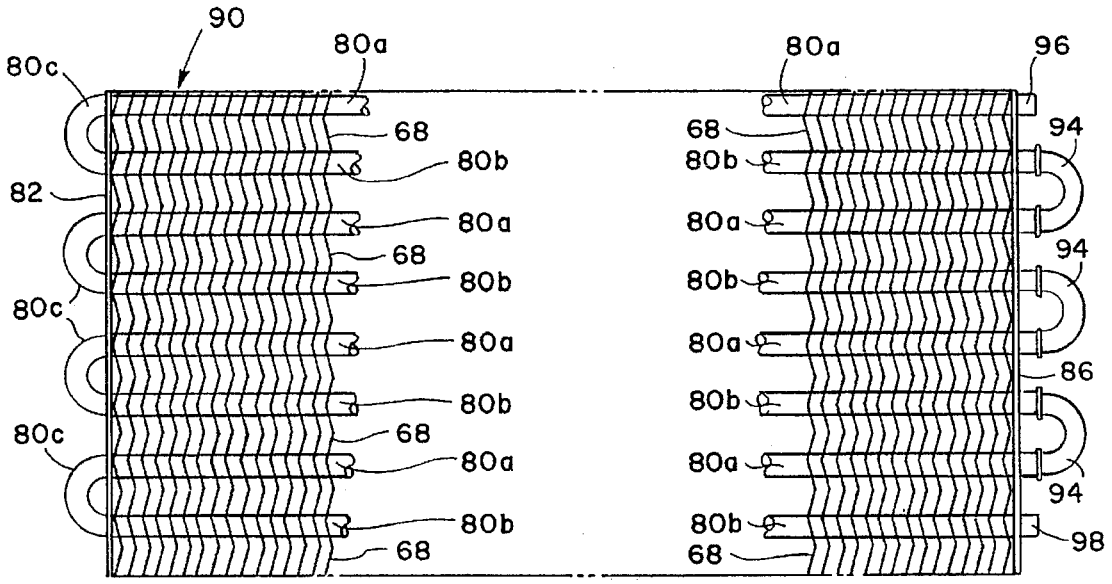
FIG. 7 is an elevation view of the assembled coil after the refrigerant carrying tube circuits have been completed by brazing.

Referring to FIGS. 1 and 7, coil slab 84 is conveyed to a brazing station without the need to first clean either hairpins 80 or fins 68. Brazing completes the coil assembly 90. During the brazing operation, the tube circuits are completed by brazing return bends, distributors and headers to respective distal ends 80*d* of each hairpin 80. In FIG. 7, only return bends 94 are shown brazed to respective distal ends 80*d* of hairpins 80, thereby forming a refrigerant circuit between an inlet end 96 and an outlet end 98 of coil 90. A certain amount of smoke is produced during a brazing operation because of the first lubricant residue on fins 68. The smoke is exhausted from the operator breathing zones and filtered. The filtered air is returned back into the manufacturing facility so as to avoid the need for an air emissions permit.

After brazing, the completed coil 90 is leak tested, as indicated by ref. no. 100 in FIG. 1, utilizing 500 psi internal pressure with coil 90 submerged in water for 20–30 seconds. Inlet and outlet ends 96 and 98 are plugged during leak testing. 500 psi air is introduced into coil 90 through the plug in inlet end 96. The water soluble, first lubricant is removed from coil 90 during the leak testing operation and drained into a sanitary sewer. The by-products of the first lubricant, including BOD's, COD's, FOG's and VOC's, are well within effluent restrictions on the manufacturing facility. Approximately 90% of the first lubricant is removed during the leak testing operation. The remaining 10% forms a hydrophilic coating, which may be air-blown dried.

After leak testing, coil 90 is blown dry to remove water therefrom and, if coil 90 is to be painted, it is routed through a dehydration oven for further drying. The dehydration oven is operated at a temperature of at least 325° F. and each coil 90 spends approximately seven minutes within the dehydration oven. The air-blow-off/dehydration oven steps of the process are indicated by ref. no. 102 in FIG. 1.

After dehydration, coil 90 may be painted, as indicated by ref. no. 104 in FIG. 1. After leak testing, the plugs are removed. Hairpins 80 are dry-air purged on the inside thereof, as indicated by ref. no. 106, to remove moisture accumulated during leak testing. If coil 90 is not painted, coil 90 need only be blown dry with high-velocity air blowers because the hydrophilic coating left by the residue of the first lubricant makes it unnecessary to dry coil 90 in a dehydration oven if coil 90 is not painted. After dry-air purging, inlet and outlet ends 96 and 98 are sealed and coil 90 is packaged for shipment, as indicated by ref. no. 108.

The use of a fin lubricant of the characteristics described above reduces the expense and time associated with the heat transfer coil manufacturing process by eliminating the need for a dedicated operation to remove the lubricant, as is required when petroleum-based fin lubricants are used. The fin lubricant is chosen to be compatible with a wide variety of fin-forming operations, including a wide range of fin pack densities and fin collar heights. The amount of the first lubricant applied to the fins as well as the amount of the second lubricant applied to the inside of the hairpins are controlled within prescribed limits. The first lubricant, being water soluble, is substantially removed from the fins during the leak testing operation so that a dedicated fin cleaning operation is not required. The first lubricant residue left on the fins after leak testing provides a hydrophilic coating which allows the fins to be air-blown dry without the need for drying in a dehydration oven. Further, the first lubricant residue provides a paint-receptive surface if the coil is to be painted. Another advantage of using the first lubricant of the type described hereinabove is that it is relatively non-volatile so that noxious vapors are not emitted into operator breathing zones and environmental emissions permits are not required. Further, coil manufacturing operations using this synthetic fin lubricant have not resulted in diminished tooling life, increased equipment maintenance or production downtime, or other related problems.

The best mode for carrying out the invention has now been described in detail. Since changes in and additions to the above-described best mode may be made without departing from the nature, spirit or scope of the invention, the invention is not to be limited to the above-described best mode, but rather only by the appended claims and their proper equivalents.

We claim:

1. A method of manufacturing a fin of a heat transfer coil, said method comprising the steps of:

providing a fin lubricator having lubricant-applying first and second rollers;

supplying a sheet of fin stock to said lubricator;

operating said first and second rollers to pull the sheet through said lubricator and supplying a lubricant to said first and second rollers so that said first and second rollers apply a predetermined amount of the lubricant to respective opposed first and second sides of the sheet as the sheet is pulled through said lubricator;

providing a fin-forming press;

feeding the sheet into said press after the lubricant has been applied to the sheet;

operating said press to pull the sheet through said press and to form the sheet into at least one fin as the sheet is pulled through said press; and coordinately controlling operation of said lubricator and said press to control movement of the sheet therethrough.

2. The method of claim 1 wherein said supplying includes providing a rotatable reel having the fin stock wound in a continuous sheet thereon and rotating the reel to unwind the sheet in the direction of said lubricator.

3. The method of claim 2 wherein said coordinately controlling includes controlling movement of the sheet so that the sheet defines a first slack loop between said reel and said lubricator and a second slack loop between said lubricator and said press.

4. The method of claim 3 wherein said controlling movement of the sheet includes disabling said first and second rollers and said feeding in response to said first slack loop reaching a first upper limit corresponding to a first minimum slack condition, disabling said rotating in response to said first said slack loop reaching a first lower limit corresponding to a first maximum slack condition, disabling said first and second rollers and said feeding in response to said second slack loop reaching a second upper limit corresponding to a second minimum slack condition and disabling said first and second rollers in response to said second slack loop reaching a second lower limit corresponding to a second maximum slack condition.

5. The method of claim 1 wherein said supplying a lubricant to said first and second rollers comprises supplying a synthetic lubricant which is devoid of petroleum ingredients and is substantially water soluble.

6. The method of claim 5 wherein the lubricant forms a hydrophilic coating on the sheet when applied thereto.

7. The method of claim 5 further including selecting said predetermined amount of the lubricant so that removal of the lubricant from said at least one fin is not required when said at least one fin is assembled with at least one tube adapted to carry a heat transfer fluid.

8. The method of claim 2 wherein said supplying the first lubricant includes controlling the amount of the first lubricant supplied to said first and second rollers so that said first and second rollers apply said first amount of the first lubricant to the sheet, said introducing including controlling the amount of the second lubricant introduced into said at least one tube.

9. The method of claim 1 wherein said supplying a first lubricant to said first and second rollers comprises supplying a synthetic lubricant which is devoid of petroleum ingredients and is substantially water soluble.

10. The method of claim 4 wherein the first lubricant forms a hydrophilic coating on said at least one fin.

11. The method of claim 1 further including providing said fin lubricator with third and fourth rollers in cooperative engagement with the respective first and second rollers, said supplying a lubricant to said first and second rollers including using said third and fourth rollers to meter the amount of lubricant supplied to said first and second rollers, whereby the amount of lubricant applied to the sheet is controlled.

12. A method of manufacturing a heat transfer coil, comprising the steps of:

providing a fin lubricator having lubricant-applying first and second rollers;

supplying a sheet of fin stock to said fin lubricator;

pulling the sheet through said lubricator and supplying a first lubricant to said first and second rollers so that said first and second rollers apply a predetermined first amount of the first lubricant to respective opposed first and second sides of the sheet as the sheet is pulled through said lubricator;

providing a fin-forming press;

feeding the sheet into said press after the first lubricant has been applied to the sheet;

operating said press to pull the sheet through said press and to form the sheet into at least one fin as the sheet is pulled through said press;

providing at least one tube adapted to carry a heat transfer fluid;

introducing a predetermined second amount of a second lubricant into said at least one tube at a predetermined location;

bending the tube at said predetermined location;

assembling said at least one tube with said at least one fin to form a coil slab;

expanding said at least one tube by a predetermined amount without introducing an additional amount of the second lubricant into said at least one tube; and forming the coil with at least one refrigerant carrying circuit by brazing said coil slab at selected locations without first removing either the first lubricant from said at least one fin or the second lubricant from said at least one tube.

13. The method of claim 12 further including providing said fin lubricator with third and fourth rollers in cooperative engagement with the respective first and second rollers, said supplying a first lubricant to said first and second rollers including using said third and fourth rollers to meter the amount of first lubricant supplied to said first and second rollers, whereby the amount of first lubricant applied to the sheet is controlled.

14. A method of manufacturing a fin of a heat transfer coil, said method comprising the steps of:

providing a fin lubricator having lubricant-applying first and second rollers;

supplying a sheet of fin stock to said lubricator;

pulling the sheet through said lubricator and supplying a lubricant to said first and second rollers so that said first and second rollers apply a predetermined amount of the lubricant to respective opposed first and second sides of the sheet as the sheet is pulled through said lubricator;

providing a fin-forming press;

feeding the sheet into said press after the lubricant has been applied to the sheet; and operating said press to pull the sheet through said press and to form the sheet into at least one fin as the sheet is pulled through said press.

15. The method of claim 14 further including providing said fin lubricator with third and fourth rollers in cooperative engagement with the respective first and second rollers, said supplying a lubricant to said first and second rollers including using said third and fourth rollers to meter the amount of lubricant supplied to said first and second rollers, whereby the amount of lubricant applied to the sheet is controlled.

16. The method of claim 14 wherein said supplying a lubricant to said first and second rollers comprises supplying a synthetic lubricant which is devoid of petroleum ingredients and is substantially water soluble.

17. The method of claim 14 wherein said supplying a lubricant to said first and second rollers includes controlling the amount of the lubricant supplied to said first and second rollers so that said first and second rollers apply a predetermined amount of the lubricant to the sheet.

18. The method of claim 17 further including selecting said predetermined amount of the lubricant so that removal of the lubricant from said at least one fin is not required when said at least one fin is assembled with at least one tube adapted to carry a heat transfer fluid.

19. The method of claim 1 wherein supplying the lubricant includes controlling the amount of the lubricant supplied to said first and second rollers so that said first and second rollers apply said predetermined amount of the lubricant to the sheet.

20. The method of claim 17 further including selecting said first and second amounts so that removal of the first lubricant from said at least one fin and the second lubricant from said at least one tube is not required.

* * * * *